US006311371B1

(12) United States Patent
Dazzo

(10) Patent No.: US 6,311,371 B1
(45) Date of Patent: Nov. 6, 2001

(54) PALLET STRIP

(76) Inventor: Frank P. Dazzo, 5220 Trenton St., Metairie, LA (US) 70006

( * ) Notice: Subject to any disclaimer, the term of this patent is extended or adjusted under 35 U.S.C. 154(b) by 0 days.

(21) Appl. No.: 09/570,760

(22) Filed: May 15, 2000

Related U.S. Application Data

(60) Provisional application No. 60/134,496, filed on May 17, 1999.

(51) Int. Cl.[7] ..... B65D 63/00

(52) U.S. Cl. ..... 24/20 R; 24/303; 206/386; 206/597

(58) Field of Search ..... 24/20 R, 303; 108/55.1, 55.3, 55.5; 217/66, 68; 206/386, 597; 410/97, 99, 100; 81/9.4; 254/134.3, 1, DIG. 14

(56) References Cited

U.S. PATENT DOCUMENTS 1,988,513 * 1/1935 Ricketts et al. ..... 410/35
2,658,614 * 11/1953 Van Patten ..... 206/595
2,664,813 * 1/1954 Rose ..... 100/25
4,050,664 * 9/1977 Daley ..... 248/346.03
4,543,035 * 9/1985 Lair ..... 414/802
4,694,962 * 9/1987 Taub ..... 206/600
4,850,283 * 7/1989 Carvin ..... 108/51.11
5,320,048 * 6/1994 Feiner ..... 108/51.11
5,706,630 * 1/1998 Hernke et al. ..... 53/399
5,921,069 * 7/1999 Hernke et al. ..... 53/589
6,044,620 * 4/2000 Hernke et al. ..... 53/399

* cited by examiner

*Primary Examiner*—Anthony Knight
*Assistant Examiner*—Ruth C. Rodriguez

(57) ABSTRACT

A thin metal strip having on both edges longitudinal side slits (4) into which strapping material (12) is inserted. The metal strip contains circular through-holes (3) through which cable (13) is inserted. At one end of the metal strip is a handgrip (2) that is used to guide the strip under a pallet platform (5). Attaching to the metal strip is a mobile magnet (15), which can be detached to align a mounting bolt (16).

10 Claims, 5 Drawing Sheets

PALLET STRIP

BACKGROUND—CROSS REFERENCES

This application is entitled to the benefit of Provisional Patent Application Ser. No. 60/134,496, Filed May 17, 1999.

BACKGROUND—FIELD OF INVENTION

This invention relates to the warehouse industry, specifically to the safe movement of inventory merchandise within and between warehouses.

BACKGROUND—GENERAL PROBLEM

Companies that own a warehouse to store their inventory receive their merchandise from a shipping company. This merchandise is commonly set upon a pallet or is delivered setting upon a pallet. After delivery, the merchandise and pallet have to be moved to another location within the warehouse or may have to be moved to another warehouse. Commonly the merchandise cargo setting upon the pallet is bulky and unwieldy. If a device is not used to secure the cargo to the pallet, the cargo may fall off the pallet. This may cause damage to the cargo and possible injury to the warehouse personnel.

One method devised to secure the cargo is to wrap the cargo in polyethylene sheets to secure the cargo to the pallet. This shrink-wrap method at times proved unsuccessful because the cargo could shift and become lopsided. The cargo could then fall off the pallet causing damage and possible injury to the warehouse personnel. Another method devised to secure the cargo to the pallet was to use straps to tie the cargo to the pallet. The straps can be utilized in conjunction with the shrink-wrap when the cargo is unwieldy. The straps are also used independently of the shrink-wrap. Up to four straps can be utilized to secure the cargo to the pallet. The straps securely attach the cargo to the pallet and restrain the cargo from shifting and becoming lopsided when the forklift truck is moving the pallet. The strapping method has proven to be a very successful method of keeping the cargo securely attached to the pallet. The straps have also been successful in keeping the cargo restrained, which prohibits the cargo from shifting from side to side and becoming lopsided.

In order to attach the cargo to the pallet, the straps have to be placed through openings beneath the pallet platform. The strap has to enter through an opening underneath the pallet platform on one side of the pallet and exit through an opening underneath the pallet on the opposite side of the pallet. The strap is then placed around the cargo and is locked shut. The cargo underneath the strap is securely attached to the pallet. Another strap placed a measured distance alongside the initial strap has to enter and exists through openings underneath the pallet platform. The second strap secures the cargo to the pallet and in addition restrains the cargo from shifting from side to side on the pallet. In some instances a four-strap method is employed. In this circumstance, an additional strap is entered underneath the pallet platform from the front opening and exits through the rear opening underneath the pallet platform. Another strap is placed a measured distance alongside the third strap and is entered from the front opening and exists through the rear opening. The four-strap method of securing cargo to the pallet is used to add additional restraint in keeping the cargo from shifting and becoming lopsided.

The problem for warehouse personnel is how to shove or pull the straps through the openings underneath the pallet platform from one side of the pallet through to the opening on the opposite side of the pallet. If the four-strap tie down method is employed, an additional problem is how to shove or pull the straps from an opening in the front of the pallet through to an opening in the rear of the pallet.

Warehouse personnel created several types of methods to solve this problem.

(a) One employee would take one end of the strap in his hand and while lying on the warehouse floor shove the strap through an opening underneath the pallet platform. A second employee lying on the opposite side of the pallet would grab the end of the strap with his hand and pulls it through the opening on the opposite side of the pallet. The strap would then be positioned around the cargo and the pallet. This procedure would be repeated two times in a two-strap tie down and four times in a four-strap tie down.

(b) Another method used by warehouse personnel to pass straps through openings in the bottom of the pallet is the broom method. One employee would use the bristle end of the broom and try to push the strap to another employee who was stationed on the opposite side of the pallet. This procedure would be repeated two times in a two-strap tie down and four times in a four-strap tie down.

(c) Another method presently being used by warehouse personnel to pass straps through openings in the bottom of the pallet is the pole method. In this method the warehouse employee uses adhesive tape to secure the end of the strap to a pole. The employee then shoves the pole through the opening at the bottom of the pallet to another employee stationed on the opposite side of the pallet. The second employee grabs the pole and pulls the pole with the strap attached through the opening on the opposite end of the pallet. The strap is then placed around the cargo. This procedure would be repeated two times in a two-strap tie down and four times in a four-strap tie down.

These methods of passing the straps through openings in the pallet have failed to solve the problem. In all of the present methods being used to pass the straps through the openings in the pallet, the employees are either lying face down on a cement floor or on their hands and knees stooping over to pass the strap through the opening to another employee. The constant repetition of lying or kneeling on a cement floor may lead to back and knee injuries. The act of an employee putting their hands underneath the pallet platform to pull the strap through the pallet opening could cause injury to the hands, face or arms. While attempting to pass the straps through the openings in the pallet, the employees are lying or knelling next to and parallel to the pallet. The pallet is loaded with cargo. The cargo could shift and topple over onto the employee and cause serious injury to the employee. In addition to the injury aspect, these methods are an inefficient use of labor. Instead of one employee being used, an additional employee must be utilized in order to pull the strap through the pallet opening.

Companies that sell small mechanical type machinery and motors receive their inventory from the shipping company on pallets. Since this merchandise is heavy and bulky it needs to be secured to the pallet. The mechanical equipment is secured to the pallet by mounting it to the pallet. The equipment is mounted to the pallet by the use of metal bolts and nuts. Warehouse personnel have to reach under the pallet platform and push a predetermined size bolt through a hole that was previously drilled in a pallet platform board. Another employee then must tighten the nut over the bolt to secure the equipment to the pallet. The equipment then can be safely moved within the warehouse.

This method of securing the small machinery to the pallet creates a safety problem.

(a) While the warehouse employee is on the cement floor pushing the bolt through the opening, the machinery is setting on the platform unsecured. The cargo could shift and topple over onto the employee and cause serious injury to the employee.

(b) In order to push the bolt through the opening, the employee has to bend down on his hands and knees and put his hand under the pallet. When the employee locates the opening he pushes the bolt through the opening. The repetition of kneeling on a cement floor may lead to back and knee problems. The act of an employee putting their hands underneath the pallet to push the bolt through the opening could cause injury to the hands or the arms.

This method of securing the machinery to the pallet is also labor intensive. A second employee is needed to attach the nut to the bolt.

Another method to attach heavy merchandise to the pallet is to secure the cargo by the use of a steel cable. The steel cable has to be placed through openings beneath the pallet platform. The cable has to enter through an opening underneath the pallet platform on one side of the pallet and exit through an opening underneath the pallet platform on the opposite side of the pallet. The cable is then placed around the cargo and is locked shut. The heavy cargo underneath the strap is securely attached to the pallet. Another cable placed a measured distance alongside the initial cable has to enter and exist through openings underneath the pallet platform. The second cable secures the heavy cargo to the pallet and in addition restrains the cargo from shifting from side to side on the pallet. In some instances two additional cables are utilized to secure the cargo to the pallet. In this circumstance, an additional cable is entered underneath the pallet platform from the front opening and exits through the rear opening underneath the pallet platform. Another cable is placed a measured distance alongside the third cable and is entered from the front opening and exists through the rear opening. The extra two cables add additional strength in keeping the heavy cargo from shifting and possible falling off the pallet.

The problem for warehouse personnel is how to shove the cable through the openings underneath the pallet platform from one side of the pallet through to the opening on the opposite side of the pallet. If four cables are used to secure the cargo, an additional problem is how to shove the cable from an opening in the front of the pallet through to the opposite opening in the rear of the pallet.

The cables used to secure the cargo to the pallet are stored in a circular position when not in use. When warehouse personnel retrieve the cables from storage, the cable is unwound from its circular position. The cable is then pushed through an opening underneath the pallet platform. The cable is rigid enough to be successful pushed through the opening on the opposite side of the pallet. However, the cable tends to curl in an upward position and gets entangled in between boards of the pallet platform. The warehouse employee then has to reach under the pallet and extricate the cable from its entangled position. The employee then resumes the task of pushing the cable through the openings in the pallet.

This method of pushing the cable through openings underneath the pallet platform has failed to solve the problem. The employee has to kneel down on the cement floor and while stooping over untangles the cable from being caught in between the boards of the pallet. The employee then resumes the task of pushing the cable through he opening. If the cable again gets tangled in between boards, he again has to stop pushing the cable and again kneel down and reach under the pallet to untangle the cable. The constant repetition of kneeling on a cement floor may lead to back and knee injuries. The act of an employee putting his hands underneath the pallet platform to untangle the cable could cause injury to the hands or arm. While attempting to untangle the cable from in between the pallet boards, the employee is kneeling next to and parallel to the pallet. The pallet is loaded with heavy cargo. The cargo could shift and topple over onto the employee and cause serious injury to the employee.

SUMMARY

In accordance with the present invention a pallet strip provides a safe, inexpensive, and easy to use devise to enable the user to tie down cargo loaded on a pallet.

OBJECTS AND ADVANTAGES

Accordingly, several objects and advantages of my invention are:

(a) To provide an apparatus which can effectively and safely pass straps through an opening underneath a pallet platform on one side of the pallet through to an opening on the opposite side of the pallet.

(b) To provide an apparatus which can effectively and safely pass straps through an opening underneath a pallet platform in front of the pallet through to an opening in the back of the pallet.

(c) To provide an apparatus, which can effectively and safely pass a bolt through a circular opening drilled through a pallet platform board.

(d) To provide an apparatus which can effectively and safely pass a round steel cable through an opening underneath a pallet platform on one side of the pallet through to an opening on the opposite side of the pallet.

(e) To provide an apparatus which can effectively and safely pass a round steel cable through an opening underneath a pallet platform on the front side of the pallet through to an opening on the back side of the pallet.

(f) To provide an apparatus which attaches and secures cargo to a pallet that limits the possible injury to warehouse employees.

(g) To provide an apparatus which attaches and secures cargo to a pallet that is simple to operate.

Further objects and advantages of my invention will become apparent from a consideration of the drawings and ensuing description.

DRAWING FIGURES

Figure 2A:
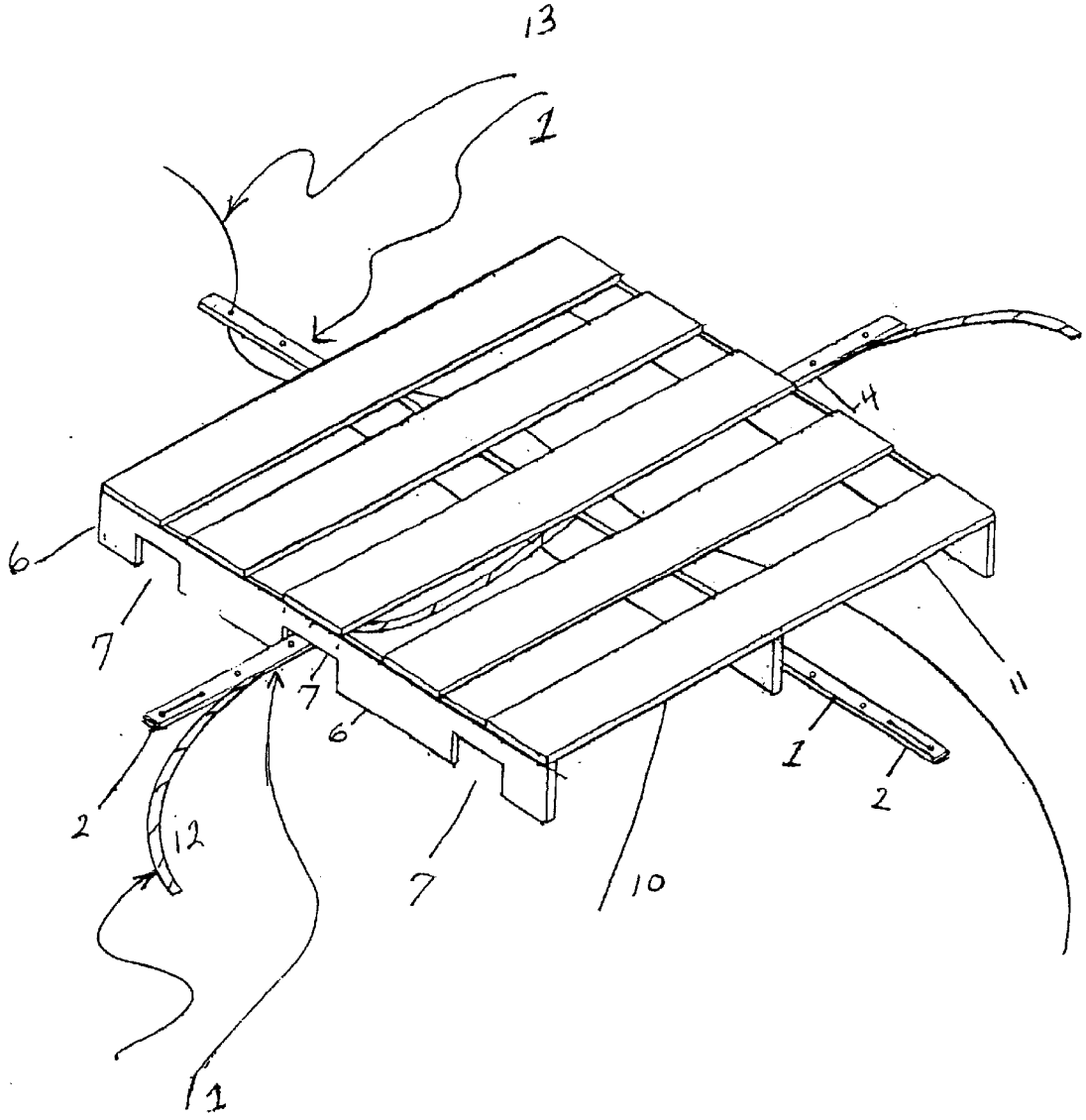

FIG. 2A shows the pallet and the pallet strip underneath the pallet platform. The pallet platform boards are shown with the front pallet openings and the side pallet openings. The pallet strip is shown with the strap meshing with the longitudinal side slit. The pallet strip and the strap material are shown going through the front and rear openings of the pallet. The pallet strip and the cable positioned through the aperture are shown going through the side openings of the pallet.

Figure 2B:
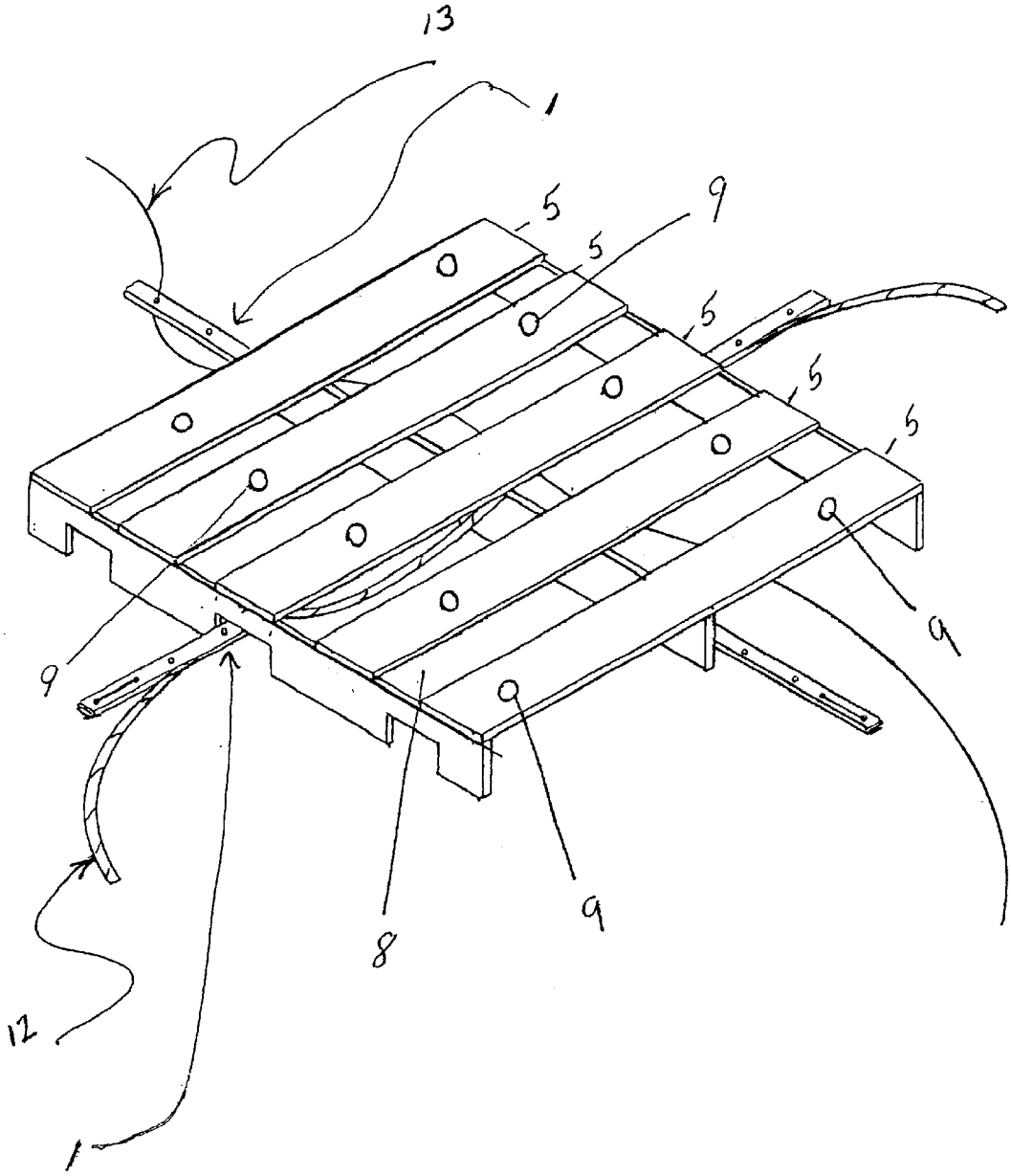

FIG. 2B shows the pallet platform with the aperture holes drilled in the platform boards. The spacing between the platform boards is shown.

Figure 3:
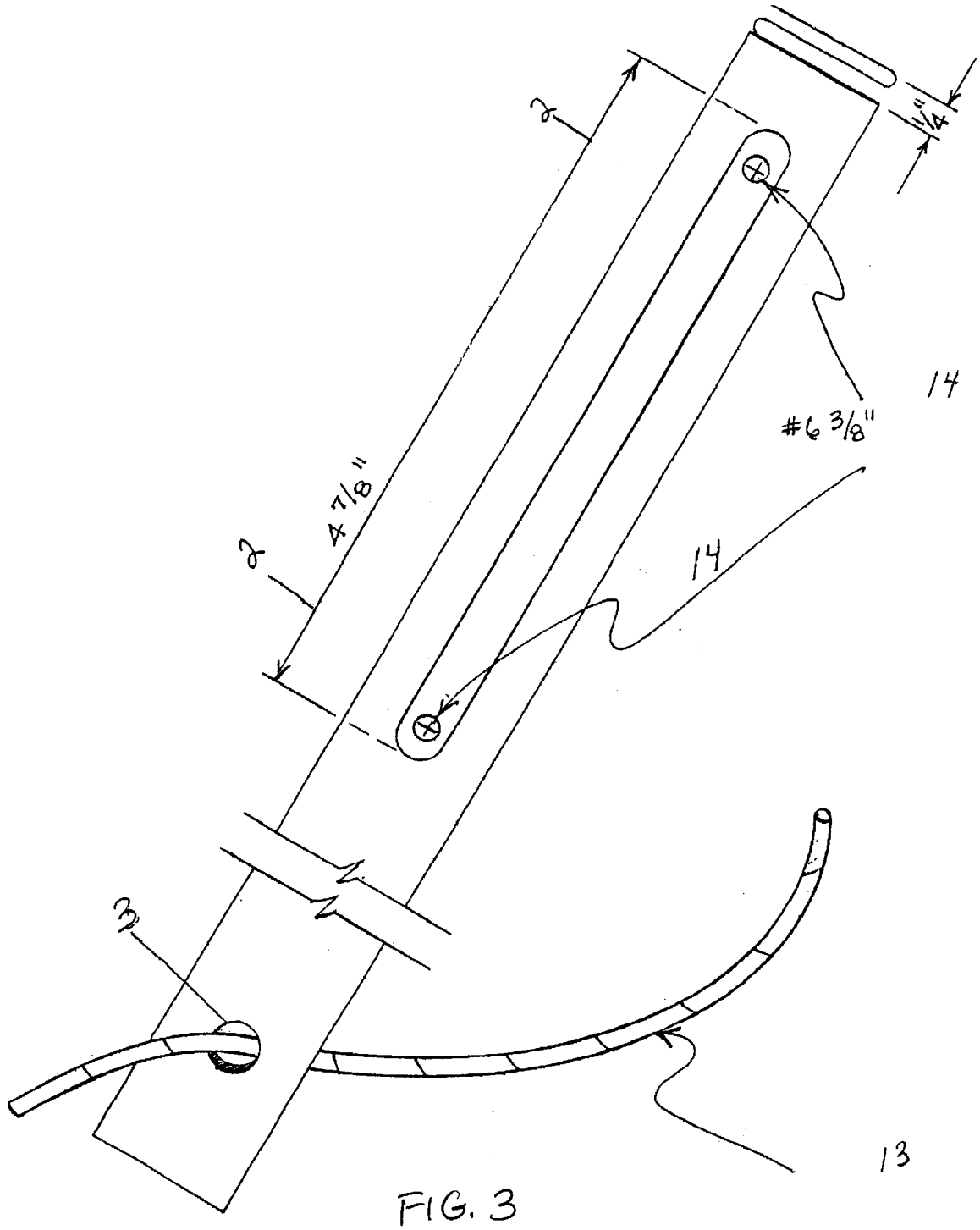

FIG. 3 shows the handgrip attached to the pallet strip and a cutoff view of the cable positioned through the aperture.

Figures 4A, 4B:
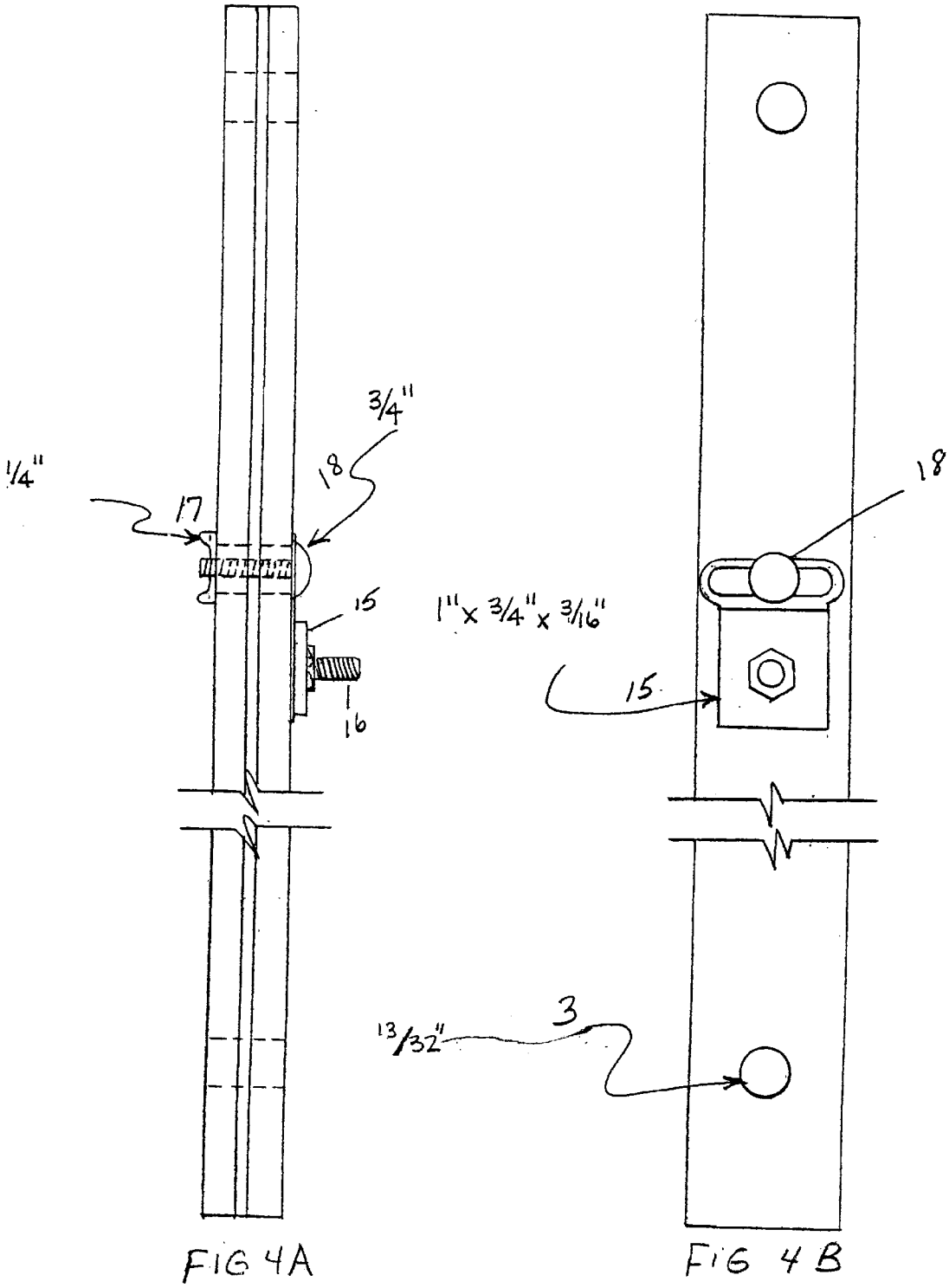

FIGS. 4A and 4B show the magnet attaching with the pallet bolt. The bolt and wing nut that attach the movable magnet to the pallet strip are shown attaching the magnet to the pallet strip.

REFERENCE NUMERAL IN DRAWINGS

1. Pallet Strip
2. Hand grip
3. Vent holes
4. Side slits
5. Pallet platform
6. Front of pallet
7. Front pallet openings
8. Space between platform boards
9. Holes drilled in platform boards
10. Side of pallet
11. Side pallet openings underneath platform
12. Strap
13. Cable
14. Screws
15. Magnet
16. Bolt
17. Wing nut for magnet holder
18. Magnet holder bolt

DESCRIPTION

Figure 1A:
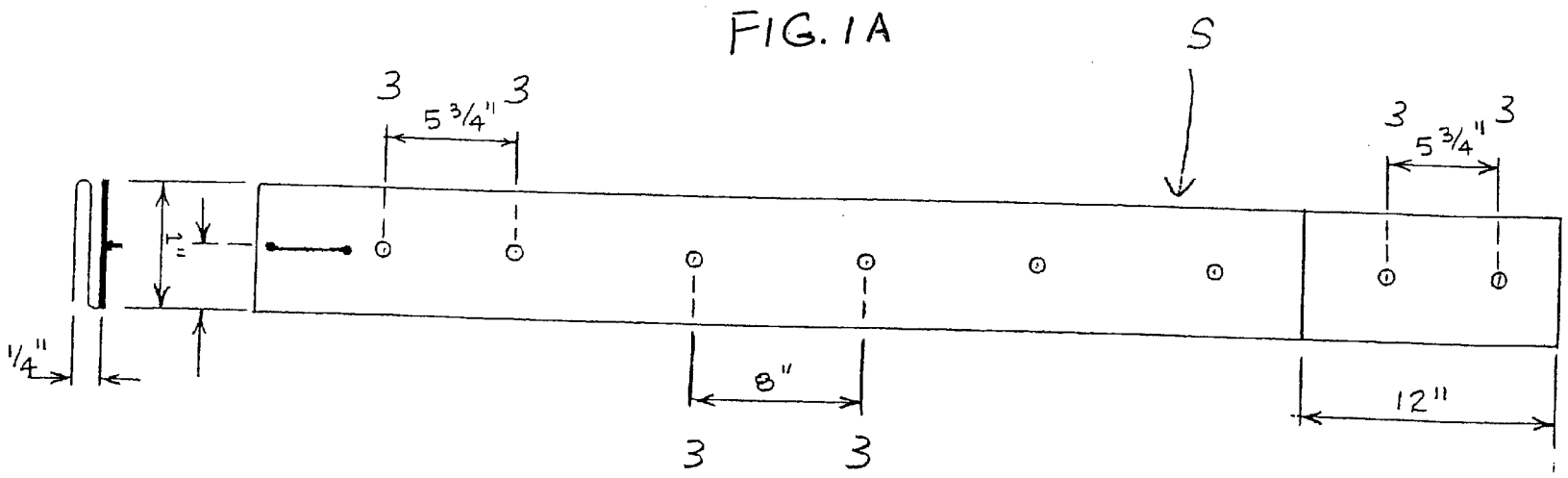
FIG. 1A shows a top view of the pallet strip. Vent holes are shown.
Figure 1B:
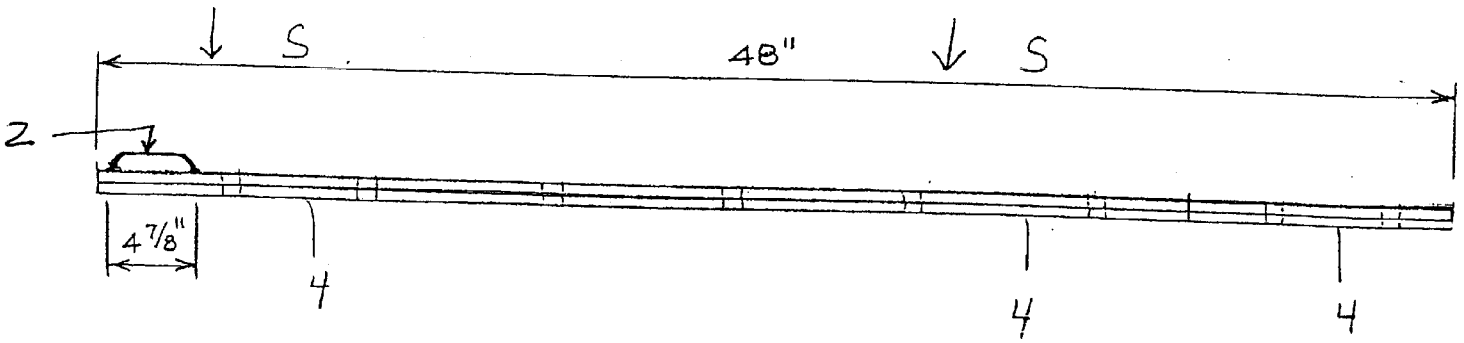
FIG. 1B shows a side view of the pallet strip with the attached handgrip. The longitudinal groove is shown on the side of the entire pallet strip.

FIGS. 1A and 1B—Preferred Embodiment

A preferred embodiment of the present invention is illustrated in FIG. 1A (top view) and FIG. 1B (side view). In the preferred embodiment, the invention is a rigid elongated S strip of metal. However, the invention can consist of any other rigid material. The present preferred length of the strip is approximately sixty inches in length. However, the length can be any size that is longer than the length of the pallet. The present width of the strip is one inch. However, the width can be any dimension that allows the strip to slide under the smallest pallet opening. On each side of the S strip 10 of metal is an longitudinal slit opening 4. The longitudinal slits 4 have an opening of 3/16 of an inch. A strap 12 is positioned in the longitudinal slit opening 4. The strap 12 remains engaged in the slit opening 4 until it is physical removed. The S metal strip has vent holes 3. A cable 13 is positioned through the vent holes 3.

FIGS. 2A and 2B

FIGS. 2A and 2B show a typical pallet. The merchandise cargo sets on top of the pallet platform 5. The pallet strip 1 is shown underneath the pallet platform 5. The pallet strip 1 is shown entering and exiting the pallet openings 7 in front and rear of the pallet 6. The pallet strip has the strap 12 meshing in the longitudinal groove opening. The pallet strip 1 is also shown entering and exiting the side pallet openings 11. The pallet strip has a cable 13 entering the aperture 3 in the pallet strip. FIG. 2B shows the pallet strip underneath the pallet platform 5. The pallet platform boards 5 are shown with circular drilled holes 9. FIG. 2B shows the space 8 between the platform boards.

FIG. 3

FIG. 3 shows the handgrip 2 of the pallet strip. The handgrip 2 is used to slide the pallet strip under the pallet platform. The cable 13 is shown positioned through the vent hole 3.

FIG. 4

FIG. 4 shows the mobile magnet 15 held in place on the pallet strip by a retaining magnet holder bolt 18, a wing nut 17 and an E clip. The mobile magnet 15 can be used on any location on the metal pallet strip. The magnet 15 holds the mounting bolt 16 securely in place on the metal pallet strip. The mounting bolt is used to mount heavy type cargo onto the pallet platform.

ADVANTAGES

From the description above, a number of advantages of my pallet strip become evident:

(a) The pallet strip is a very easy devise to operate. All warehouse employees can use it. If straps are needed to secure cargo onto the pallet, the employee simple inserts the strap in the side slits of the pallet strip. The employee than slides the pallet strip through the pallet openings under the pallet platform by guiding the pallet strips with the handgrip. The employee than walks to the opposite side of the pallet to obtain the pallet strip which is protruding from the opposite side pallet openings. The employee picks up the pallet strip and disengages the strap from the sideslip. The employee than locks the strap. If the employee needs two straps, he can simple insert the strap into the side slip on one side of the pallet strip and than insert a strap into the side slip on the other side of the pallet strip.

Using the pallet strip eliminates the need for the employees to lie down or kneel on the cement floor and reach under the pallet to secure a strap. The pallet strip eliminates the constant stooping over to pass the strap through the pallet opening to another employee. There is no need for an employee to put their hands under the pallet. The elimination of these duties reduces the chance of injury. Since the employee is not kneeling or lying on side of the pallet, the risk of injury from cargo toppling over is greatly reduced.

The use of the pallet strip also eliminates the need of an additional employee to pull the strap through the pallet opening. The act of sliding the pallet strip under the pallet platform eliminates the need of another employee. One employee can complete the strapping of the cargo onto the pallet.

(b) The pallet strip is also very easy to use if the cargo has to be mounted to the pallet. Instead of the employee reaching under the pallet to push the mounting bolt through the aperture, the mounting bolt is attached to the pallet strip by use of the mobile magnet. When the bolt is aligned with the aperture, the entire pallet strip is raised to insert the bolt through the opening. The mounting nut is than attached to the bolt.

The pallet strip eliminates the need for the employee to reach under the pallet platform to insert the bolt through the aperture in the platform board. This greatly decreases the possibility of injury to the employee.

(c) The pallet strip is also very easy to use if the cargo has to be secured by use of steel cable. The steel cable is inserted through a vent hole in the pallet strip. The employee than slides the pallet strip through a pallet opening by guiding the strip with the hand grips. The employee than walks to the opposite side of the pallet to obtain the pallet strip which is protruding from the opposite side pallet openings. The employee picks up the pallet strip and disengages the cable from the vent opening. The employees than locks the cable to safely secure the cargo.

The use of the pallet strip eliminates the problem of the cable curling upward and getting caught in between the platform boards. This eliminates the need of an employee to reach under the pallet and extricate the cable from its entangled position. The employee does not have to be stooping over and risking injury to his back and knees. The use of the pallet strip also eliminates possible injury because there is no need for the employee to be kneeling along side of the pallet loaded with cargo.

CONCLUSION, RAMIFICATIONS, AND SCOPE

Accordingly, the reader will see that the pallet strip provides an inexpensive, easy to manufacture device to safely attach cargo sitting on a pallet to the pallet. The tie down of the cargo prevents the load from shifting and possible falling off the pallet and causing damage to the cargo and possible injury to a warehouse employee. Use of the pallet strip produces a more safe method to obtain the wrap material that is used to strap down the cargo to the pallet. Use of the pallet strip decreases the possibility of injury to the warehouse employee who is attempting to tie down the cargo. Use of the pallet strip produces an inexpensive, efficient, and simple devise that can be utilized in the warehouse industry to improve the present day technique of tying down cargo onto a pallet.

Although the description above contains many specificities, these should not be construed as limiting the scope of the invention but as merely providing illustrations of some of the presently preferred embodiments of this invention. For example, the length and width of the metal strip can be changed, the strip could be painted, the number of vent holes could be altered, the size of the vent holes could be changed, and the handgrip altered to different specifications.

Thus the scope of the invention should be determined by the appended claims and their legal equivalents, rather than by the examples given.

I claim:

1. A pallet strip for passing a strap beneath a pallet comprising:

a flat thin rigid structure having a first longitudinal groove extending the length of the structure for the placement of a strap, the cross-sectional dimensions of the structure being small enough so that the pallet strip can fit within a passageway formed beneath a pallet;

a plurality of apertures formed along a longitudinal extent of the structure for the attachment of a cable to the pallet strip; and a handgrip formed at one end of the structure so that the pallet strip can be pushed through the passageway.

2. The pallet strip of claim 1 further comprising a magnet attached to the structure so that a bolt may be positioned upright on the pallet strip and placed beneath a pallet for attaching a load to the pallet.

3. The pallet strip of claim 1 wherein the structure is made of metal.

4. The pallet strip of claim 1 wherein the structure includes a second longitudinal groove opposite the first longitudinal groove.

5. The pallet strip of claim 1 wherein the apertures are evenly spaced.

6. The pallet strip of claim 5 wherein the apertures extend the entire length of the pallet strip.

7. A method of attaching a strap to a pallet, the pallet including at least one passageway for the passage of at least one strap, the method employs the use of a pallet strip having an elongated structure and being formed of a rigid material with an elongated groove extending the length of the pallet strip, the method comprising:

placing the strap within the longitudinal groove of the pallet strip;

passing the pallet strip and strap through the passageway of the pallet;

removing the strap from the pallet strip while maintaining the strap within the passageway; and joining the ends of the strap together to secure the strap to the pallet.

8. The method of attaching a strap to a pallet as set forth in claim 7, wherein the strip includes a plurality of apertures for holding a cable.

9. The method of attaching a strap to a pallet as set forth in claim 8, wherein the strap is a cable.

10. The method of attaching a strap to a pallet as set forth in claim 7, wherein the strip includes a magnet for holding a bolt in an upright position.

* * * * *